US007328869B1

(12) United States Patent
Zies

(10) Patent No.: US 7,328,869 B1
(45) Date of Patent: Feb. 12, 2008

(54) SHEET PRODUCT DISPENSING DEVICE

(76) Inventor: George Philip John Zies, 300 Maple Dr., Satellite Beach, FL (US) 32937

( * ) Notice: Subject to any disclaimer, the term of this patent is extended or adjusted under 35 U.S.C. 154(b) by 0 days.

(21) Appl. No.: 11/467,311

(22) Filed: Aug. 25, 2006

(51) Int. Cl.
*B65H 75/18* (2006.01)

(52) U.S. Cl. ..... 242/597.7

(58) Field of Classification Search ..... 242/597.7, 242/423, 423.1, 423.2
See application file for complete search history.

(56) References Cited

U.S. PATENT DOCUMENTS

| | | | | |
|---|---|---|---|---|
| 1,187,705 | A | | 6/1916 | Calvert |
| 1,871,189 | A | | 8/1932 | Miller |
| 2,072,519 | A | | 3/1937 | Carpenter et al. |
| 2,978,197 | A | | 4/1961 | Anderson |
| 3,430,877 | A | | 3/1969 | Berlet |
| 4,222,532 | A | | 9/1980 | DeLuca |
| 4,487,376 | A | * | 12/1984 | Compton |
| 4,690,345 | A | * | 9/1987 | Cotey |
| 4,720,053 | A | * | 1/1988 | Vance |
| 4,738,385 | A | * | 4/1988 | Bell |
| 4,741,486 | A | | 5/1988 | Ancona et al. |
| D326,580 | S | | 6/1992 | Brazis |
| 5,170,956 | A | * | 12/1992 | McTaggart |
| 5,297,750 | A | | 3/1994 | Hunt |
| 5,788,136 | A | * | 8/1998 | Othman |
| 5,938,141 | A | * | 8/1999 | Kanbar |
| 6,357,687 | B1 | * | 3/2002 | Liu ..... 242/422.4 |
| 6,478,246 | B2 | * | 11/2002 | Fahringer |
| 6,776,368 | B1 | | 8/2004 | Duncan et al. |
| 6,793,097 | B2 | * | 9/2004 | Kamenstein |
| 6,832,739 | B1 | | 12/2004 | Kraus |
| 7,124,976 | B1 | * | 10/2006 | DeVincenzo |
| 7,140,573 | B1 | * | 11/2006 | Jerstroem et al. |
| 2002/0070308 | A1 | * | 6/2002 | Fahringer |
| 2002/0171003 | A1 | | 11/2002 | Johnson et al. |
| 2006/0284001 | A1 | * | 12/2006 | Paradise et al. |

FOREIGN PATENT DOCUMENTS

| | | | |
|---|---|---|---|
| DE | 36 13 988 | * | 9/1987 |
| WO | WO 95/20905 | | 8/1995 |

* cited by examiner

*Primary Examiner*—William A Rivera
(74) *Attorney, Agent, or Firm*—Mark R. Malek, Esq.; Zies, Widerman, Sutch & Malek

(57) ABSTRACT

A sheet product dispensing device includes a base, and a shaft connected to the base and extending upwardly therefrom. The sheet product dispensing device also includes a top removably connected to an upper portion of the shaft. The top may be longitudinally moveable between an engaged position and a disengaged position when connected to the upper portion of the shaft.

11 Claims, 4 Drawing Sheets

SHEET PRODUCT DISPENSING DEVICE

FIELD OF THE INVENTION

The present invention relates to the field of a sheet product dispensing device and, more particularly, to a sheet product dispensing device that stops rotation of a sheet product roll when a sheet product is being dispensed therefrom.

BACKGROUND OF THE INVENTION

Many sheet product dispensing devices exist for holding and dispensing sheet products that are stored on sheet product rolls. For example, it is well known to provide a paper towel holder for holding and dispensing paper towels stored on paper towel rolls. One problem with existing sheet product dispensing devices, however, is that they do not allow a user to stop rotation of the sheet product roll without engaging the sheet product roll. This problem is enhanced when a user with wet hands makes contact with the paper towels on the paper towel roll in order to stop rotation of the paper towel roll to remove a paper towel. Instead, a user may unroll several paper towels from the paper towel roll in an attempt to rapidly separate a paper towel from a paper towel roll that has not been stopped from rotation.

Some sheet product dispensing devices are illustrated, for example, in U.S. Pat. No. 2,978,197 to Anderson, U.S. Pat. No. 3,430,877 to Berlet, U.S. Pat. No. 4,222,532 to DeLuca, and U.S. Design Pat. No. 326,580 to Brazis. The above referenced sheet product dispensing devices are designed to be mounted to a surface to horizontally dispense sheet products stored on a sheet product roll. These sheet product dispensing devices, however, do not allow the sheet product roll to be selectively stopped from rotation when the sheet product is being dispensed without the user engaging the sheet product roll.

U.S. Published Patent Application No. 2002/0171003 by Johnson et al. also discloses a horizontally mounted sheet product dispensing device to receive a sheet product roll. This device includes a gripper that engages the sheet product roll to selectively stop the sheet product roll from rotation. The gripper, however, may be cumbersome to the operation of the sheet product dispensing device and may also increase the time needed to change the sheet product roll.

Some sheet product dispensing devices are arranged to hold a sheet product roll in a vertical configuration. For example, U.S. Pat. No. 6,776,368 to Duncan et al. and U.S. Pat. No. 6,832,739 to Kraus both disclose paper towel holders that hold a paper towel roll in a vertical configuration. Both paper towel holders include contact members that engage an outer surface of the paper towel rolls during rotation. These contact members, however, may not be sufficient to stop rotation of the paper towel roll and may not allow a user to tear one paper towel from the paper towel roll without either unrolling numerous paper towels from the paper towel roll or requiring the user to engage the paper towel roll to selectively stop rotation thereof.

SUMMARY OF THE INVENTION

In view of the foregoing background, it is therefore an object of the present invention to provide a sheet product dispensing device that advantageously allows a user to selectively stop rotation of a sheet product roll without engaging the sheet product stored on the sheet product roll when being dispensed from a sheet product dispensing device.

This and other objects, features, and advantages in accordance with the present invention are provided by a sheet product dispensing device comprising a base, a shaft connected to the base and extending upwardly therefrom, and a top removably connected to an upper portion of the shaft. The top may be longitudinally moveable between an engaged position and a disengaged position when connected to the upper portion of the shaft.

In one embodiment of the sheet product dispensing device the shaft may include a first shaft portion, and a second shaft portion that slidably engages the first shaft portion. The first and second shaft portions preferably have openings formed therein. The sheet product dispensing device may also comprise a spring member carried within the openings of the first and second shaft portions so that a portion of the spring member is carried by the opening formed in the first shaft portion, and another portion of the spring member is carried by the opening formed in the second shaft portion.

In another embodiment of the sheet product dispensing device, the top has an opening formed in a bottom medial portion thereof. This embodiment of the sheet product dispensing device also preferably includes a spring member carried by the opening in the top to engage the upper portion of the shaft.

In yet another embodiment of the sheet product dispensing device, the base has an opening formed in a medial portion thereof. This embodiment of the sheet product dispensing device also preferably comprises a spring member carried by the opening and engaging a bottom portion of the shaft.

In still another embodiment of the sheet product dispensing device, the shaft includes a laterally expandable medial portion. The engaged position of this embodiment of the sheet product dispensing device is defined by the shaft being compressed to extend the medial portion in a scissor-like fashion to selectively engage an inner portion of a tube of a sheet product roll. The disengaged position of this embodiment of the sheet product dispensing device is defined by the medial portion of the shaft being released to selectively disengage the inner portion of the tube of the sheet product roll allowing the sheet product roll to freely rotate when a sheet product is being dispensed from the sheet product roll.

In each embodiment of the sheet product dispensing device, the top preferably includes a bottom surface having a non-slip texture. The top is preferably threadably connected to the upper portion of the shaft. Each embodiment of the sheet product dispensing device advantageously allows a user to stop rotation of the sheet product roll without engaging the sheet product roll. In other words, each embodiment of the sheet product dispensing device advantageously eliminates the need to engage the sheet product stored on the sheet product roll when dispensing the sheet product from the sheet product roll.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternate embodiments.

Figure 1:
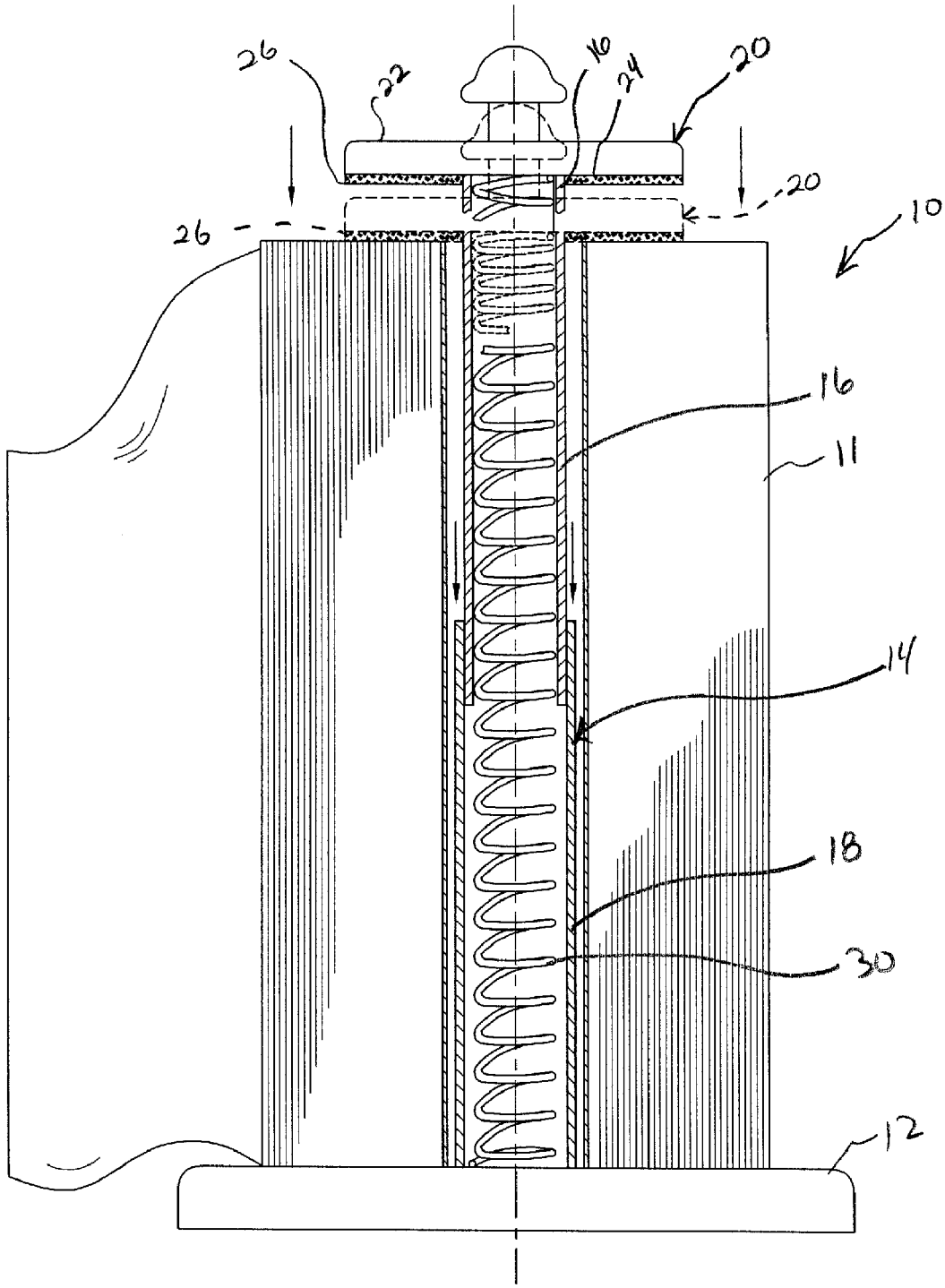
FIG. 1 is an elevation view of a first embodiment of a sheet product dispensing device according to the present invention having portions cut away.

Referring initially to FIG. 1, a first embodiment of the sheet product dispensing device 10 according to the present invention is now described in greater detail. The sheet product dispensing device 10 is preferably used to dispense a sheet product stored on a sheet product roll 11. The sheet product may be dispensed from the sheet product roll 11 when the sheet product roll is vertically carried by the sheet product dispensing device 10. Although the sheet product roll 11 is illustrated as being carried in a vertical position by the sheet product dispensing device 10, those having skill in the art will appreciate that the sheet product dispensing device of the present invention may be configured to allow the sheet product roll to be carried in a horizontal position as well.

The sheet product dispensing device 10 of the present invention includes a base 12 and a shaft 14 connected to the base and extending upwardly therefrom. The sheet product dispensing device 10 also illustratively includes a top 20 removably connected to an upper portion of the shaft 14.

The top 20 is longitudinally moveable between an engaged position and a disengaged position when connected to the upper portion of the shaft 14. More specifically, when in the disengaged position, the top 20 is illustratively spaced-apart from an upper portion of the sheet product roll 11. When in the engaged position, a bottom portion of the top 20 illustratively contacts an upper portion of the sheet product roll 11. Those having skill in the art will appreciate that the top 20 may be moved between the engaged and disengaged positions by applying a force thereto. In other words, a user may depress the top 20 to move the top from the disengaged position to the engaged position. Similarly, when the user releases the top 20, the top may move from the engaged position to the disengaged position, thereby allowing the sheet product roll 11 to be selectively, and freely, rotated by the user.

The top 20 includes an upper surface 22 and a bottom surface 24 opposite the upper surface. More specifically, the bottom surface 24 of the top 20 is adjacent a top portion of the sheet product roll 11 having the sheet product being dispensed therefrom. The bottom surface 24 of the top 20 includes a layer 26 affixed thereto. The layer 26 preferably has a first side having a non-slip texture. The first side of the layer 26 is positioned adjacent the top of the sheet product roll 11. A second side of the layer 26 is adjacent the bottom portion 24 of the top 20.

The second side of the layer 26 may include an adhesive material so that the layer may be adhesively connected to the bottom portion 24 of the top 20. Those having skill in the art will appreciate that the layer 26 may be connected to the bottom portion 24 of the top using many other techniques as well. The first side of the layer 26 having the non-slip texture may, for example, be made of a rubber material, or any other type of material providing a similar non-slip texture, as understood by those skilled in the art.

The top 20 is preferably threadably connected to the upper portion of the shaft 14. More particularly, the upper portion of the shaft may be threaded, and an opening formed in the top 20 may have inner side walls that are also threaded. Therefore, the top 20 may be threadably attached to the upper portion of the shaft 14. Those having skill in the art will appreciate that the top 20 may also be connected to the upper portion of the shaft 14 by any other technique as well.

The shaft 14 of the first embodiment of the sheet product dispensing device 10, illustrated in FIG. 1, includes a first shaft portion 16 and a second shaft portion 18 that slidably engages the first shaft portion. More particularly, the second shaft portion 18 preferably has an inner diameter that is slightly larger than the outer diameter of the first shaft portion 16. Accordingly, the first shaft portion 16 may slide within the second shaft portion 18.

The first and second shaft portions 16, 18 illustratively have openings formed therein. In other words, the first and second shaft portions 16, 18 are provided by tubular members. The openings extend substantially the length of the first and second shaft portions 16, 18. Those having skill in the art will appreciate that at least one of the first and second shaft portions 16, 18 includes a stop connected to an inner portion thereof to prevent separation of the first and second shaft portions.

In the first embodiment of the sheet product dispensing device 10, the top 20 is removably connected to an upper portion of the second shaft portion 18. Further, the top 20 is longitudinally moveable between an engaged position and a disengaged position when connected to the upper portion of the second shaft portion 18. As illustrated in FIG. 1, for example, when the top 20 is moved to the engaged position, the first end of the layer 26 engages the top of the sheet product roll 11 to prevent rotation of the sheet product roll when dispensing the sheet product therefrom. When the top 20 is in the disengaged position, the layer 26 is spaced apart from the top of the sheet product roll 11 to allow the sheet product roll to freely rotate.

The first embodiment of the sheet product dispensing device 10 also illustratively includes a spring member 30 carried by the openings in the first and second shaft portions 16, 18. More specifically, the spring member 30 is carried within the openings of the first and second shaft portions 16, 18 so that a portion of the spring member is carried by the opening formed in the first shaft portion, and another portion of the spring member is carried by the opening formed in the second shaft portion. Those skilled in the art will appreciate that the spring member 30 is compressible to advantageously allow the shaft 14 to be compressed and released so that the top 20 may be moved between the engaged and disengaged positions when connected to the upper portion of the shaft.

Figure 2:
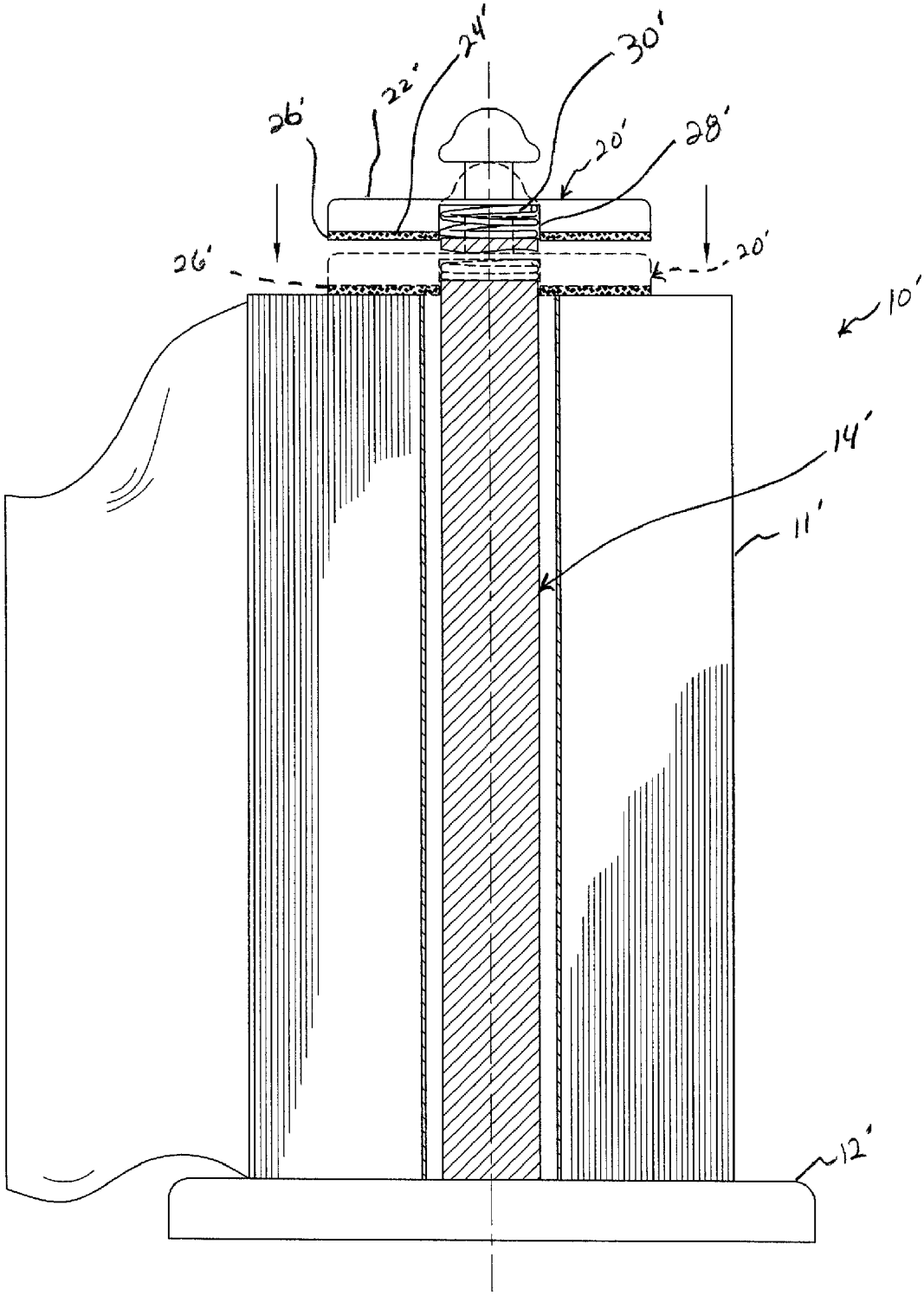
FIG. 2 is an elevation view of another embodiment of a sheet product dispensing device according to the present invention having portions cut away.

Referring now more specifically to FIG. 2, a second embodiment of the sheet product dispensing device 10' is now described in greater detail. In the second embodiment of the sheet product dispensing device 10', an opening 28' is formed in a bottom medial portion of the top 20'. A spring member 30' is illustratively carried by the opening 28' in the top 20' to engage the upper portion of the shaft 14'. More specifically, a first end of the spring member 30' engages an end of the opening 28' formed in the bottom portion of the top 20'. The second end of the spring member 30' is positioned to engage the upper portion of the shaft 14'.

The positioning of the spring member 30' within the opening 28' formed in the top 20' of the sheet product dispensing device 10' advantageously allows the top to be moved between the engaged and disengaged positions. Again, when the top 20' is moved from the disengaged position to the engaged position, the layer 26' on the bottom portion 24' of the top 20' advantageously engages a top portion of the sheet product roll 11' to prevent rotation of the sheet product roll when dispensing the sheet product therefrom. The other elements of the second embodiment of the sheet product dispensing device 10' are similar to those of the first embodiment of the sheet product dispensing device 10, are labeled with prime notation, and require no further discussion herein.

Figure 3:
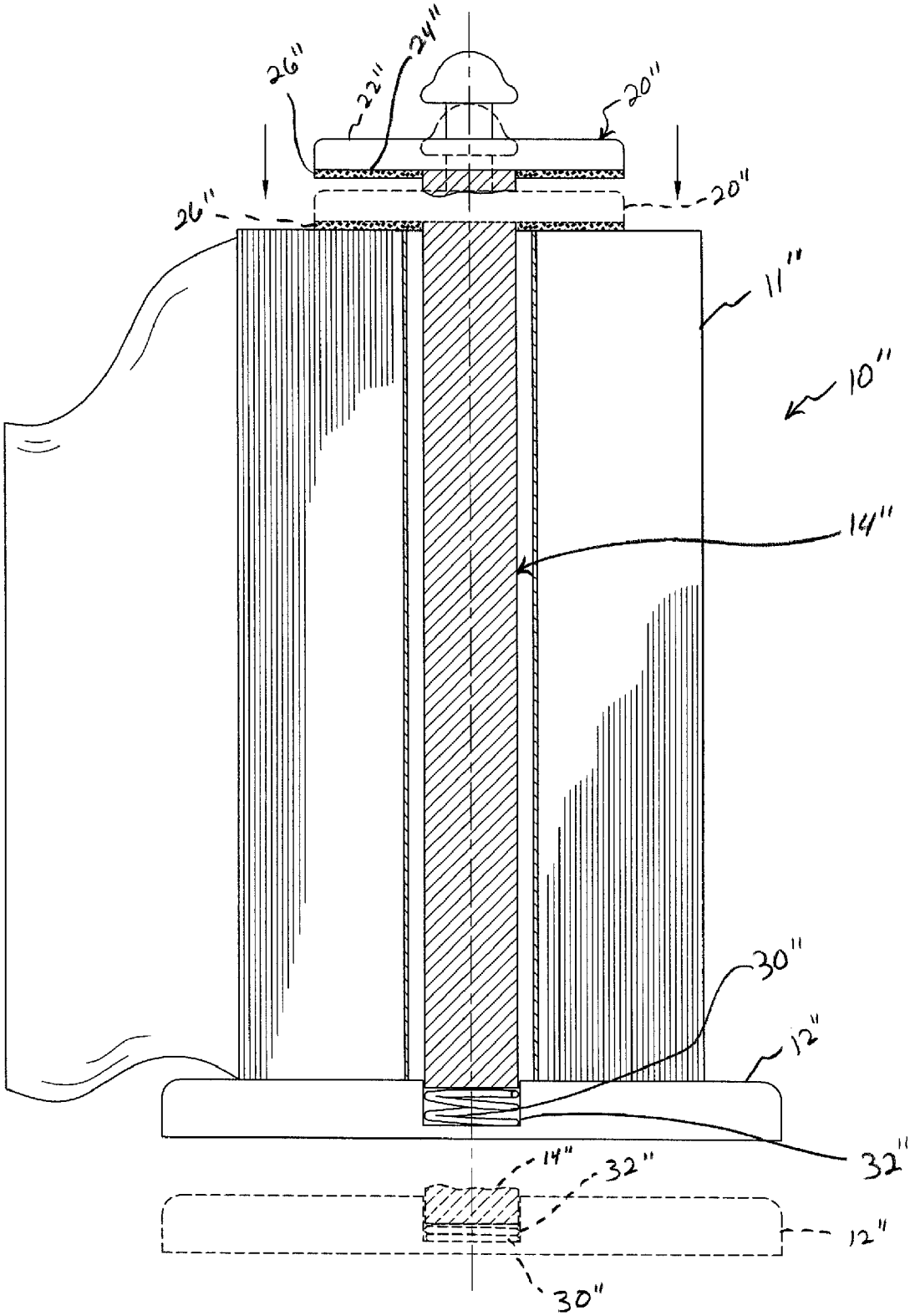
FIG. 3 is an elevation view of still another embodiment of a sheet product dispensing device according to the present invention having portions cut away.

Referring now additionally to FIG. 3, a third embodiment of the sheet product dispensing device 10" is now described in greater detail. In the third embodiment of the sheet product dispensing device 10", the base 12" has an opening 32" formed in a medial portion thereof. A spring member 30" is carried by the opening 32" and engages a bottom portion of the shaft 14". More specifically, a first end of the spring member 30" preferably engages an end of the opening 32" formed in the base 12", and another end of the spring member preferably engages a bottom portion of the shaft 14".

Accordingly, the top 20" that is connected to the upper portion of the shaft 14" may be moved between the engaged position and the disengaged position by applying a force thereto. Therefore, when a force is applied to the top 20", i.e., the user pushes on the top, the spring member 30" may be compressed, and the top may be moved from a disengaged position to an engaged position. When in the engaged position, the layer 26" on the bottom surface 24" of the top 20" engages the sheet product roll 11" to prevent rotation of the sheet product roll when the sheet product is being dispensed therefrom. The other elements of the third embodiment of the sheet product dispensing device 10" are similar to those in the first embodiment of the sheet product dispensing device 10, are labeled with double prime notation, and require no further discussion herein.

Figure 4:
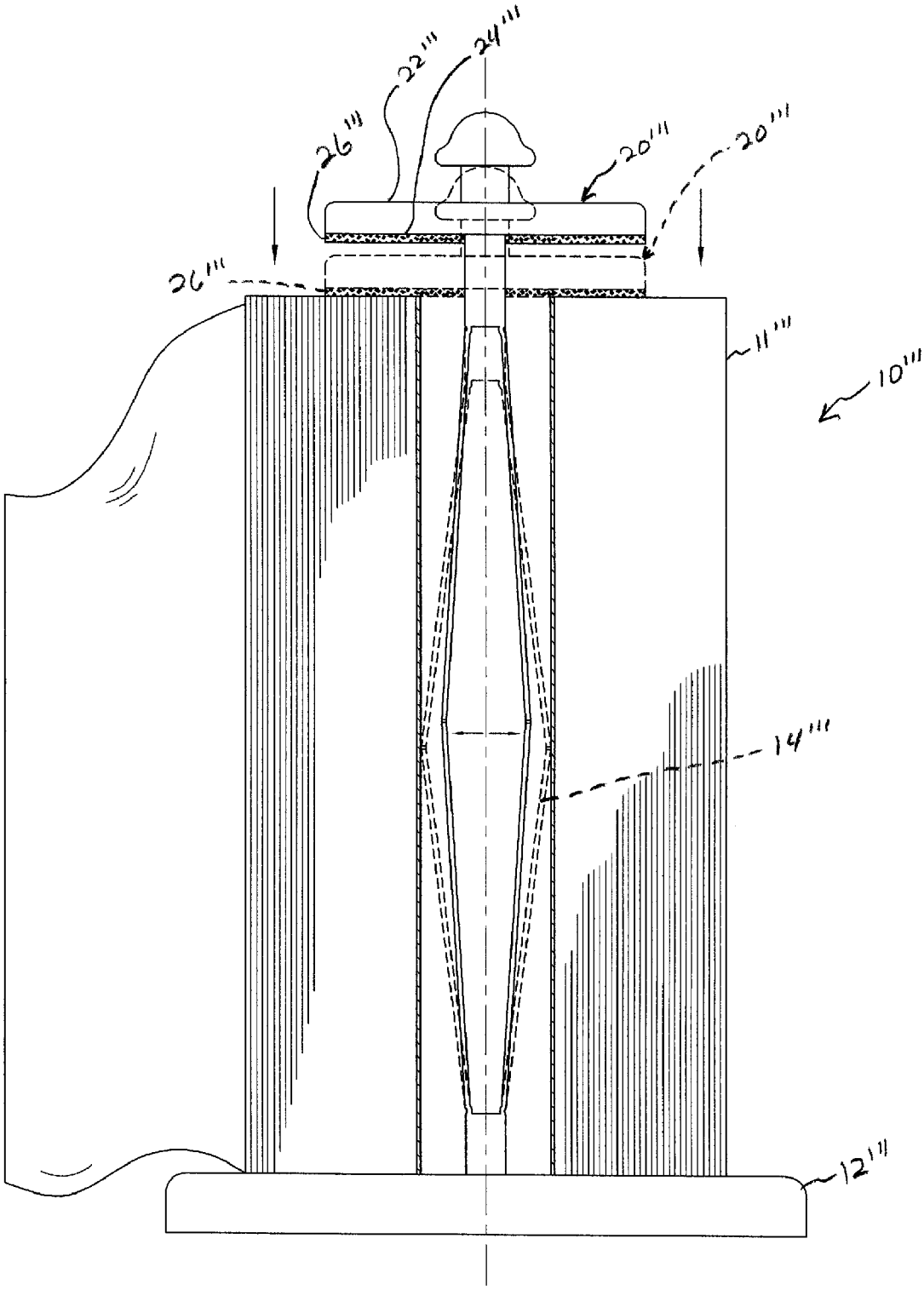
FIG. 4 is an elevation view of yet another embodiment of a sheet product dispensing device according to the present invention having portions cut away.

Referring now additionally to FIG. 4, a fourth embodiment of the sheet product dispensing device 10''' is now described in greater detail. The shaft 14''' of the third embodiment of the sheet product dispensing device 10''' is laterally expandable. More particularly, a medial portion of the shaft 14''' is laterally expandable. Similar to the previous embodiments of the sheet product dispensing device 10, 10', 10" described herein, the fourth embodiment of the sheet product dispensing device 10''' provides for the top 20''' to be moved between an engaged position and a disengaged position.

More specifically, the laterally expandable medial portion of the shaft 14''' may be extended in a scissor-like fashion to selectively engage an inner portion of the tube of the sheet product roll 11'''. To extend the medial portion of the shaft 14''', the top 20''' is pushed downwardly by the user to move the top from a disengaged position to an engaged position. When in the engaged position, the medial portion of the shaft 14''' extends outwardly to engage an inner surface of the tube of the sheet product roll 11''' to prevent rotation of the sheet product roll when dispensing a sheet product therefrom. Although the fourth embodiment of the sheet product dispensing device 10''' illustratively includes the layer 26''' having a non-slip texture, those having skill in the art will appreciate that the fourth embodiment of the sheet product dispensing device may advantageously prevent rotation of the sheet product roll 11''' when the sheet product is being dispensed therefrom without inclusion of the layer.

The top 20''' may be moved to the disengaged position when released. The disengaged position is defined by the layer 26''' on the bottom surface of the top 20''' being spaced apart from the upper portion of the sheet product roll 11''', and the medial portion of the shaft 14''' being released to selectively disengage the inner portion of the tube of the sheet product roll 11''', thereby allowing the sheet product roll to selectively and freely rotate.

Similar to the previous embodiments of the sheet product dispensing device 10, 10', 10", the fourth embodiment of the sheet product dispensing device 10''' may be moved from the disengaged position to the engaged position when a user applies a force to the top 20'''. In other words, if the user depresses the top 20''', the top may be moved from the disengaged position to the engaged position. When the user releases the top 20''', the top may freely move from the engaged position to the disengaged position.

The medial portion of the shaft 14''' may be hinged to allow the scissor-like movement between the engaged and disengaged positions. Further, the shaft 14''' may be made of a plastic material to allow for flexibility adjacent to the medial portion thereof. Those skilled in the art will appreciate that the shaft 14''' may be made of any material allowing for flexibility adjacent the medial portion thereof so that the shaft may be moved in a scissor-like fashion. The other elements of the fourth embodiment of the sheet product dispensing device 10''' are similar to those of the first embodiment of the sheet product dispensing device 10, are labeled with triple prime notation, and require no further discussion herein.

The embodiments of the sheet product dispensing device 10, 10', 10", 10''' illustrated in FIGS. 1-4 show the top 20, 20', 20", 20''' being moved between the disengaged position and the engaged position. Those having skill in the art, however, will appreciate that the base 12, 12', 12", 12''' may be moved between the engaged and disengaged positions. More specifically, if the sheet product dispensing device 10, 10', 10", 10''' is mounted to a wall, for example, the base 12, 12', 12", 12''' or the top 20, 20', 20", 20''' may be moved between the engaged and the disengaged positions.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A sheet product dispensing device comprising:

a base;

a shaft connected to said base and extending upwardly therefrom, said shaft comprising a first shaft portion and a second shaft portion that slidably engages said first shaft portion, said first and second shaft portions having openings formed therein;

a top removably connected to an upper portion of said shaft; and at least one spring member carried within the openings of said first and second shaft portions so that a portion of the at least one spring member is carried by the opening formed in said first portion and another portion of the at least one spring member is carried by the opening formed in said second shaft portion.

2. A sheet product dispensing device according to claim 1 wherein said top includes a bottom surface having a non-slip texture.

3. A sheet product dispensing device according to claim 1 wherein said top is threadably connected to the upper portion of said shaft.

4. A sheet product dispensing device comprising:

a base;

a shaft connected to said base and extending upwardly therefrom, said shaft comprising a first shaft portion, and a second shaft portion that slidably engages the first shaft portion, said first shaft portion having an inner diameter that is larger than an outer diameter of said second shaft portion, said first and second shaft portions having respective openings formed therein;

a top removably connected to an upper portion of said second shaft portion; and at least one spring member carried by the openings of the first and second shaft portions so that a portion of the at least one spring member is carried by the opening formed in the first shaft portion and another portion of the at least one spring member is carried by the opening formed in the second shaft portion;

said top being longitudinally moveable between an engaged position and a disengaged position when connected to the upper portion of said second shaft portion.

5. A sheet product dispensing device according to claim 4 wherein said top includes a bottom surface having a non-slip texture.

6. A sheet product dispensing device according to claim 4 wherein said top is threadably connected to the upper portion of said shaft.

7. A sheet product dispensing device comprising:

a base having an opening formed in the medial portion thereof;

a shaft connected to said base and extending upwardly therefrom;

a top removably connected to an upper portion of said shaft; and at least one spring member carried by the opening in the base and engaging a bottom portion of said shaft;

said top being longitudinally movable between an engaged position and a disengaged position when connected to the upper portion of said shaft.

8. A sheet product dispensing device according to claim 7 wherein said top includes a bottom surface having a non-slip texture.

9. A sheet product dispensing device comprising:

a base;

a shaft connected to said base and extending upwardly therefrom, said shaft including an upper portion, a lower portion, and a laterally expandable medial portion; and a top removably connected to the upper portion of said shaft, said top including a bottom surface having a non-slip texture;

said top being longitudinally movable between an engaged position and a disengaged position when connected to the upper portion of said shaft;

wherein the engaged position is defined by said shaft being compressed to laterally extend the medial portion in a scissor-like fashion to selectively engage an inner portion of a tube of a sheet product roll.

10. A sheet product dispensing device according to claim 9 wherein the disengaged position is defined by the medial portion of said shaft being released to disengage the inner portion of a tube of a sheet product roll allowing the sheet product roll to rotate.

11. A sheet product dispensing device according to claim 9 wherein said top is threadably connected to the upper portion of said shaft.

* * * * *